United States Patent [19]

Webb et al.

[11] 4,073,607

[45] Feb. 14, 1978

[54] GAS COMPRESSOR SYSTEM

[75] Inventors: Paul Dale Webb, Tioga, Pa.; Henry William Morse, Savona, N.Y.

[73] Assignee: Ingersoll-Rand Company, Woodcliff Lake, N.J.

[21] Appl. No.: 709,653

[22] Filed: July 29, 1976

[51] Int. Cl.[2] ..... F04C 29/04

[52] U.S. Cl. ..... 418/86; 418/94

[58] Field of Search ..... 418/9, 86, 94, 102, 418/83, 91; 415/115, 116, 175, 177, 179; 417/372, 366, 243, 228

[56] References Cited

U.S. PATENT DOCUMENTS

| | | | |
|---|---|---|---|
| 1,098,440 | 6/1914 | Hicks, Jr. et al. | 418/94 |
| 1,905,521 | 4/1933 | Steiner | 417/228 X |
| 2,184,197 | 12/1939 | Schutte | 417/366 |
| 3,280,750 | 10/1966 | White | 415/115 X |
| 3,405,604 | 10/1968 | Lysholm | 418/86 X |

FOREIGN PATENT DOCUMENTS

| | | | |
|---|---|---|---|
| 665,762 | 10/1938 | Germany | 415/177 |
| 2,123,737 | 11/1972 | Germany | 418/86 |
| 2,110,940 | 10/1971 | Germany | 418/94 |
| 2,207,342 | 8/1973 | Germany | 415/175 |

*Primary Examiner*—Carlton R. Croyle
*Assistant Examiner*—Leonard Smith
*Attorney, Agent, or Firm*—Bernard J. Murphy

[57] ABSTRACT

In the embodiment depicted, the system comprises a gas compressing arrangement of first and second rotary compressing stages with an intercooler and an aftercooler for condensing and removing moisture from the compressed gas product. In order to cool the gas compressor, generally, and the second-stage rotor shafts in particular, the cooled, de-moisturized, compressed-gas product is used. Thus, the second-stage rotor shafts are axially bored or hollowed, and a tube is supported within the bore. The tube is through-connected with the outlet of the aftercooler to admit the cooled, compressed gas product into the bore, and, in turn, the compressed gas product is discharged from the bore. Accordingly, the cooled, compressed gas product is cycled through the bore, constantly to cool the shafts all the while that the compressor is running, or under load.

11 Claims, 3 Drawing Figures

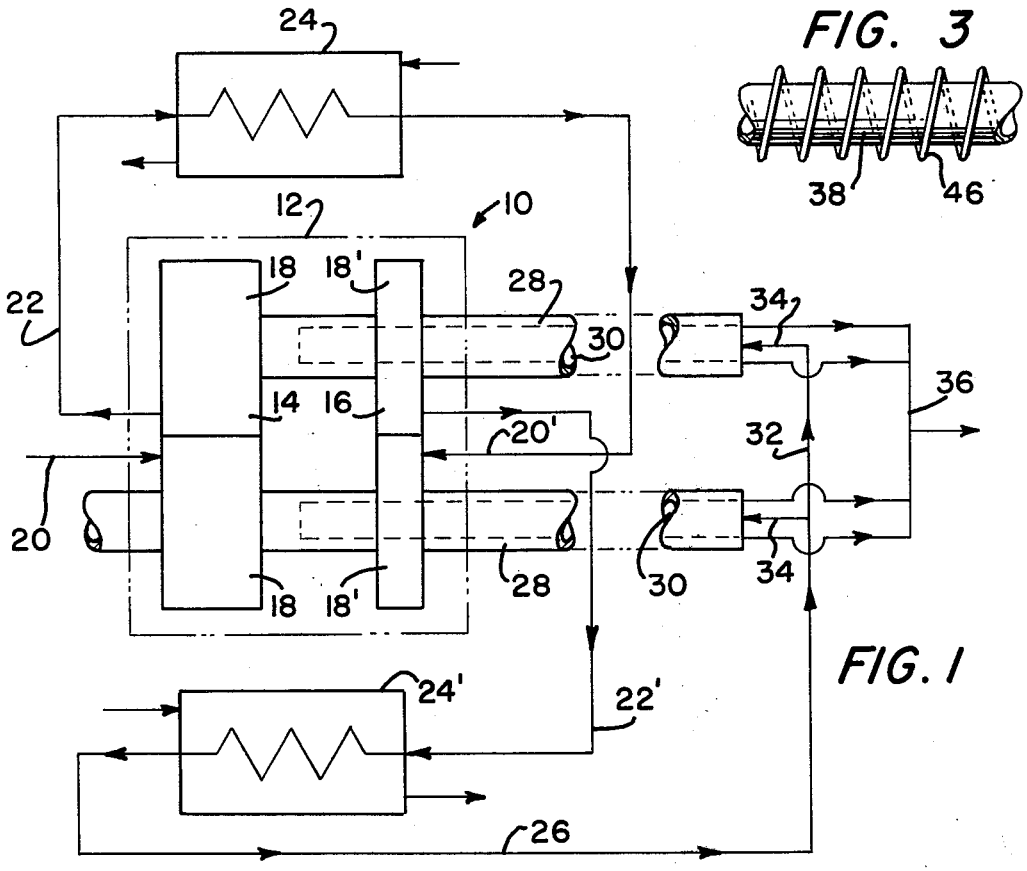
FIG. 1
FIG. 3
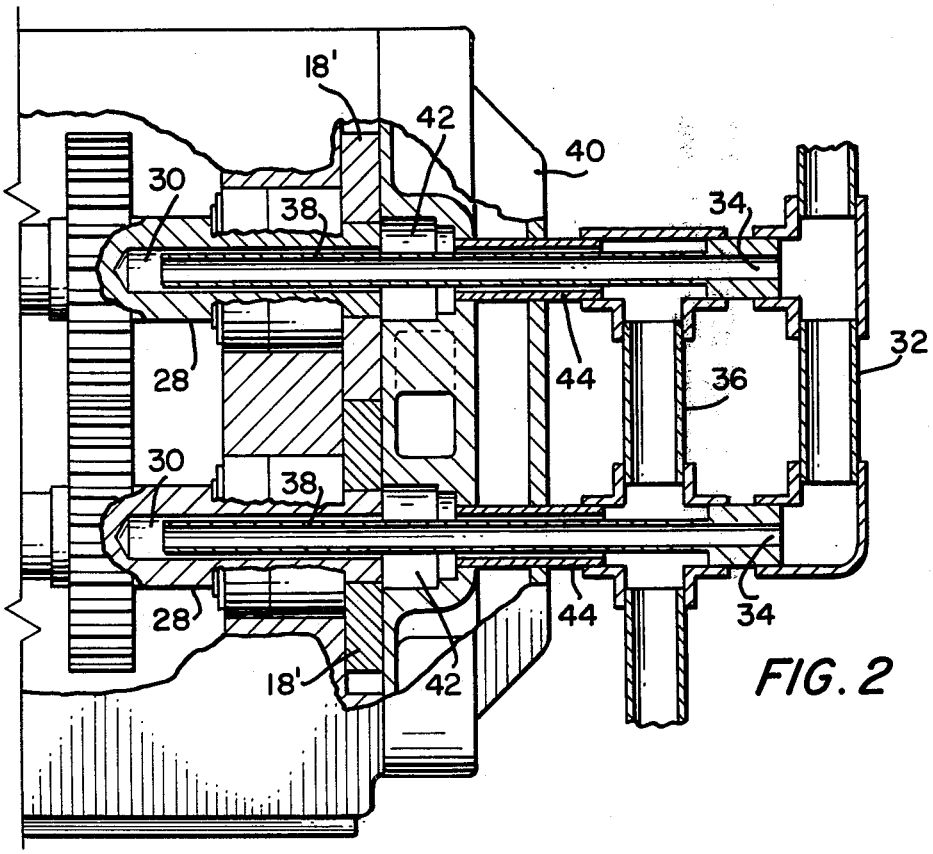
FIG. 2

GAS COMPRESSOR SYSTEM

The invention pertains to gas compressor systems, and in particular to a simple means of removing heat from the shafts of a rotary, positive-displacement compressor.

The performance of a rotatry, positive-displacement compressor depends upon the amount of clearance between rotor lobes, between the rotor outside diameters and the housing, plus the clearance at the side of the rotors. The clearance at the side of the rotors must be large enough to prevent rotor-to-housing contact as the compressor operates both at full load and at no load. There is an axial movement of the rotors, however, which is a result of the temperature difference between the housing and shaft multiplied by the length of shaft between the rotor and, for instance, a shaft-supporting thrust bearing multiplied by the coefficient of thermal expansion. This axial movement, this thermal migration of the rotor toward an adjacent, parallel, housing side wall, requires that sufficient clearance be provided therefor of course. Also, in the provisioning of a sufficient clearance, a "product" leakage path is provided, however militating against the efficiency of the system.

To inhibit thermal growth of shafts (and other structures) in gas compressor systems, it is well known to define cored passages in the housings and circulate coolant (water or air) therethrough. Typically, these prior cooling arrangements comprise separate sub-systems of conduits, coolers, pumps, coolant-supply, reservoirs, and the like. Accordingly, notwithstanding the efficiency of these sub-systems, they entail considerable expense and maintenance.

The foregoing considered, then, it is an object of this invention to set forth improved means for inhibiting thermal growth of gas compressor structures. It is also an object of this invention to define a gas compressor system which does not require a separate and distinct coolant. Particularly, it is an object of this invention to disclose means for reducing the temperature difference between a rotor shaft of a rotary piston and the housing therefor by utilizing cool air from an aftercooler of the system. Another object of the invention is to set forth a gas compressor system comprising a housing; said housing having a bore formed therewithin; first means coupled to said housing for admitting gas to said bore; second means coupled to said housing for discharging compressed gas from said bore; means, movably mounted within said bore, operative for compressing gas admitted by said first means and for conducting gas compressed thereby to said second means; said compressing and conducting means including a shaft and a piston carried by said shaft; further including means coupled to said second meansfor cooling compressed gas discharged by said second means; said shaft having means for receiving cooled compressed gas therewithin, via one end thereof, for effecting a cooling of said shaft, and means for venting such received cooled gas therefrom, via siad one end thereof; and means intercoupling said gas cooling means with said shaft gas receiving means.

Further objects of this invention, as well as the novel features thereof, will become more apparent by reference to the following description taken in conjunction with the accompanying figures in which:

FIG. 1 is a schematic diagram of a two-stage, rotary, positive displacement, gas compressor incorporating the invention;

FIG. 2 is a cross-sectional view in elevation of the second stage of the compressor of FIG. 1, showing the employment of the invention therein in a greater detail; and FIG. 3 is an illustration of a fragment of a shaft-cooling, compressed-gas tube comprised by the invention depicting the use of an optional gas-swirling, helical land about the tube.

Shown in FIG. 1 is a two-stage gas compressor 10, of a type as set forth in co-pending U.S. patent application Ser. No. 577,347, filed on May 14, 1975, now U.S. Pat. No. 3,989,413 by W. A. McGahan, et al, for a Gas Compressor Unloading Means, or as comprised by U.S. Pat. No. 3,472,445, issued to Arthur E. Brown, on Oct. 14, 1969, for a Rotary Positive Displacment Machine. Compressor 10 comprises a housing 12 represented by a dashed-line enclosure block. Compressor 10 has first and second stages 14 and 16 each of which comprises a pair of cooperating, lobed and recessed, mating rotors 18 and 18' (i.e., rotary pistons) which ingest gas and compress same for delivery.

As shown in FIG. 1, the first stage 14 receives the gas product by way of inlet 20, and discharges the compessed p product, via line 22, to an intercooler 24. From the intercooler, the compressed gas product is supplied to the inlet 20' of the second stage 16, and the output thereof is conducted via line 22' to an aftercooler 24'. Typically, the de-moisturized product of the latter, conducted via line 26, would be the final product of the compressor. According to the novel teaching of the invention, however, the rotary shafts 28 have axial bores 30 to receive therein the cooled and de-moisturized gas product as it issues from the aftercooler 24'. Accordingly, the product of the aftercooler 24' is conducted via a manifold line 32, and taps 34 into the axial bores 30 of the shafts (shown particularly in the second stage half of the compressor 10) to induce cooling of the compressor generally, and particularly to cool the rotary shafts 28. Then this cooling gas product is discharged from the shaft bores 30, via a mamifold line 36.

As shown in FIG. 2 in more detail, the shafts 28 are partially bored along the axes thereof and rotates with the rotary pistons 18'. Means not shown lock the pistons 18' and shafts 28 together for common rotation. Within each bore 30 there is supported a hollow tube 38. The outlet line 26 of the aftercooler 24' is connected with the manifold line 32 which supplies the cooled, compressed gas there-through, via taps 34, into the axially supported tubes 38. The cooling gas product returns to manifold 36.

In this second stage portion of the compressor 10 an end housing cover 40 defines cavities 42 concentrically about the axial centers of the rotary shafts 28. The gas product being discharged from foreshortened ends of the axially-supported tubes 38, returns outwardly toward cover 40 and enters these cavities. The cavities 42 are in communication with concentrically arranged conduits 44 which, in turn, open onto the manifold 36.

By these means, then, compressor/shaft cooling is efficiently effected through the use of no extraneous coolant. Rather, the very compressor and aftercooler product itself is employed to dissipate compressor heat. It is contemplated that the internal diameter of the tubes 38 and the cross-sectional area of the annular discharge paths (about the tubes 38) shall be such as to offer substantially little impedance to the gas flow — in order that no significant pressure drop will occur. As suggested by FIG. 2, where the gearing is depicted intermediate of the housing, the second stage rotors 18' are over-hung. No seals are shown in the area of the outboard faces of the rotors 18' and the end housing cover 40 with which they form an interface because, while not shown, the compressor 10 has its oil system in a center section or porton of the housing. As a consequence of this arrangement, product gas at delivery pressure (100 psig, for example) can be introduced into said area (i.e., the outboard faces of rotors 18' and their interface with end housing cover 40) without seal losses. Then, the conduct, by tubes 38, of product gas (priorly cooled in aftercooler 24'), into cavities 42, which open onto the over-hung shaft ends and rotor faces, pressurizes these cavities at the delivery pressure of the gas (approximately 100 psig.), and presents this pressure also to the rotors' outboard faces-to-end housing cover interface. If this arrangement were not provided, this interface area would subsist at some considerably reduced pressure — about 75 per cent, or so (approximately 75 psig, for example) of the product gas delivery pressure. Our "delivery" pressurization of the interface area does cause some increase of gas leakage across the outboard faces of the rotors 118', as compared to compressors which do not have this arrangement. However, the apparent increase of leakage is actually less than would be presumed, as the leakage gas is cool rather than hot.

To further enhance internal cooling of the compressor 10, through the cooling of the shafts 28, it is proposed that the tubes 38 carry helical lands 46 — as shown in FIG. 3. Thus, the existing cooling gas will be caused to swirl about the tubes 38. The net effect of this will be to increase the exposure time of given volumes of cooling gas to the wall surfaces of the bores 30, and will direct the cooling gas, with more surety, to these wall surfaces.

While we have described our invention in connection with specific embodiments thereof it is to be clearly understood that this is done only by way of example and not as a limitation to the scope of our invention as set forth in the objects thereof and in the appended claims.

We claim:

1. A gas compressor system, comprising:

a housing:

said housing having a bore formed therewithin;

first means coupled to said housing for admitting gas to said bore;

second means coupled to said housing for discharging compressed gas from said bore;

means, movably mounted within said bore, operative for compressing gas admitted by said first means and for conducting gas compressed thereby to said second means;

said compressing and conducting means including a shaft which has an axial bore formed therewithin and a piston carried by said shaft; further including means coupled to said second means for cooling compressed gas discharged by said second means;

means for introducing cooled compressed gas into said axial bore via one end of said shaft for effecting a cooling of said shaft, and means for venting such cooling gas from said shaft via said one end thereof; and means intercoupling said gas cooling means with said gas introducing means; wherein said piston is a rotary piston, is overhung on said shaft and, relative to said shaft, has inboard and outboard faces;

said shaft is supported in said housing and is rotatively driven about an axis, to rotate said piston;

said housing has an end cover having an innermost surface which forms an interface with said outboard face of said rotor, and said housing further has an annular cavity formed about said axis which opens onto said interface; and at least one of said cooled gas-introducing and -venting means opens onto said cavity.

2. A gas compressor system, according to claim 1, wherein:

said gas-introducing means and gas-venting means comprises means for conducting gas into and out of said shaft in a first extended flow path of circular cross-section and a second extended flow path of annular cross-section.

3. A gas compressor system, according to claim 1, wherein:

said venting means directly communicates with said cavity;

said introducing means penetrates said cavity; and said venting and introducing means both penetrate said housing.

4. A gas compressor system, according to claim 3, wherein:

said venting and introducing means are concentrically arranged, with one thereof enveloping the other thereof.

5. A gas compressor system, according to claim 1, wherein:

said gas-introducing means and gas-venting means comprises means for conducting gas into and out of said shaft in counter-current, parallel flow paths.

6. A gas compressor system according to claim 5, wherein:

said gas-introducing and -venting means includes means causing said conducting gas to describe a swirl pattern during movement thereof along at least one of said flow paths.

7. A gas compressor system, according to claim 5, wherein:

said gas-introducing and -venting means includes a wall means, disposed in said shaft bore, defining said parallel flow paths.

8. A gas compressor system, according to claim 7, wherein:

said gas-introducing and -venting means includes means causing said conducting gas to describe a swirl pattern during movement thereof along at least one of said flow paths; and said swirl-pattern causing means comprises a land carried by said wall means.

9. A gas compressor system according to claim 7, wherein:

said elongate bore in said shaft has a given length;

said wall means comprises a tube, of less than said given length, mounted in said shaft bore spaced-apart from surfaces of said shaft bore.

10. A gas compressor system, according to claim 9, wherein:

said shaft and said tube are arranged for effecting a relative rotation therebetween.

11. A gas compressor system, according to claim 9, wherein:

said gas-introducing and -venting means includes means causing said conducting gas to describe a swirl pattern during movement therof along at least one of said flow paths; and said swirl-pattern causing means comprises a helical land carried by said tube.

* * * * *